United States Patent [19]

Snow

[11] 4,241,627

[45] Dec. 30, 1980

[54] HAND TOOL FOR OPENING AMPULS

[75] Inventor: Thomas G. Snow, Vineland, N.J.

[73] Assignee: Owens-Illinois, Inc., Toledo, Ohio

[21] Appl. No.: 5,655

[22] Filed: Jan. 22, 1979

[51] Int. Cl.[3] ..... B67B 7/00

[52] U.S. Cl. ..... 81/3.46 R; 81/43

[58] Field of Search ..... 30/94; 81/3 R, 3.46 R, 81/3.46 A, 9.5 B, 43

[56] References Cited

U.S. PATENT DOCUMENTS

| | | | |
|---|---|---|---|
| 1,490,459 | 4/1924 | Fergusson | 81/9.5 B |
| 2,503,517 | 4/1950 | Sirica | 81/9.5 B X |
| 2,566,434 | 9/1951 | Toth et al. | 81/9.5 B X |

*Primary Examiner*—James G. Smith

*Attorney, Agent, or Firm*—John R. Nelson; Myron E. Click; David H. Wilson

[57] ABSTRACT

A hand tool for use in providing protective manual assistance in opening frangible hermetically sealed ampuls having an elongated main body portion and an integral axially projecting removable end merging with the body portion through a peripherally constricted and relatively weakened neck designed to fracture and separate the removable end from the body portion in response to a bending stress manually applied to the removable end portion. The hand tool comprises an essentially rigid one-piece construction which may be manually gripped within one hand of the user and which is designed to accommodate its reuse with widely varying ampul sizes. The hand tool features a pair of elongate protective finger grips arranged in side-by-side interspaced relationship at one end and integrally merging together at an opposite longitudinal end to define a generally U-shaped central recess within which to position the removable end of a sealed ampul. One of the finger grips is provided with a fulcrum having a relatively narrow edge surface upon which to seat the constricted neck of the ampul while the other finger grip is provided with a counterposed bearing surface arranged to overreach the removable end of the ampul and bear against the same in response to manually pivoting the hand tool against the removable end of the ampul. Whereupon, the fulcrum is caused to counteractively bear against the constricted neck and impart a selectively concentrated bending moment thereto which causes the neck to fracture cleanly along a narrowly defined transverse fracture path. During such removal of the removable end, the finger grips protectively shield the fingers of the user from injurious contact with the residual raw edges of the fractured ampul.

8 Claims, 5 Drawing Figures

HAND TOOL FOR OPENING AMPULS

BACKGROUND OF THE INVENTION

1. Field of the Invention

The present invention relates in a generalized manner to hermetically sealed glass containers such as ampuls and the like which, after being filled through a filling opening with the desired product, are hermetically sealed by flame-sealing the filling opening. Such sealing protectively isolates the container's contents against contamination and evaporation. In more particular respects, the present invention pertains to a one-piece, hand tool for use in providing protective manual assistance in breaking off, or snapping off, the end portion of such hermetically sealed containers to accommodate removal of the container's contents.

2. Description of the Prior Art

In the past, it has been customary practice to package various types of fluid medicaments, pharmaceuticals, substances such as, among others, injectables and like fluids requiring aseptic or sterile packaging in hermetically sealed containers such as glass ampuls, or the like, in order to more effectively protect the container's contents from contamination and evaporation. Conventionally, such containers have been structured in such manner that removal of the contents is effected by manually snapping off, or breaking off, an axially projecting end portion of the container along a constricted and/or weakened peripheral neck region selectively located between the main body portion and the axially projecting end portion of the container. Such breakage is ordinarily accomplished by manually grasping the axially projecting end, or tip end, in one hand and grasping the body portion of the container, or ampul, in the other hand so that the intended breakage location is located intermediate each hand. Thereafter, the tip end may be broken off in response to the application of a manually exerted flexural force, or bending force imparted to the container. When properly executed, the container will ordinarily fracture in the constricted and/or weakened neck region and thereby provide accessibility to the container's contents. However, on occasion, the container may unexpectedly fracture in a location other than in the constricted neck region. Also, small glass fragments may be generated during breakage which are apt to enter the container. No less importantly, the residual raw edges remaining after fracturing of the container may present potential sources of hand injury.

In an endeavor to minimize the danger of hand injury associated with manual opening of hermetically sealed containers of the type described, various types of tools have been devised and used in the past. Among the various types of known tools, or devices, some are structured or designed in such manner that they form an associated part of the container and are essentially nonreusable with other containers. U.S. Pat. No. 1,956,568 is exemplary of a device of this latter type. Moreover, many of the more common versions of finger protective devices take the form of a protective sleeve which is shaped to fit in relatively snug relationship around the removable end of the container. Typical of such protective sleeve types of devices are, among others, those shown and described in U.S. Pat. Nos. 3,544,020; 3,720,250 and 3,862,654. Due in at least part to the relatively close or snug-fitting styling of the protective finger devices shown and described in these last-mentioned patents, they tend to be restricted in usage to essentially one size ampul-type container. Thus, several different sizes of these devices would be required for use in conjunction with the various size ampuls commonly used by physicians, veterinarians, nurses and others for administration of prescribed amounts of the container's contents. Moreover, the time and inconvenience involved in selecting the proper size device necessary for opening each particular size ampul would render them unsuitable as reusable devices. In recognition of such unsuitability, the latter type of protective finger devices are customarily sold or distributed as single use items which after use are discarded together with the removed end of the ampul or container. To minimize the added production, storage and shipping costs, which result in consequence of furnishing a protective finger device as a companion item for each container requires that inexpensive and lightweight fabricating materials be utilized. Thus, such nonreusable devices are ordinarily fabricated from relatively flexible materials, such as treated paper, rubber, molded plastics and similar nonrigid materials. Nonetheless, the additional cost is quite substantial when considered in the light of the high volume usage of such ampuls or containers in various health care facilities and institutions.

No less importantly, the protective finger devices heretofore known in the art generally are not designed or structured to minimize the occurrence of objectionable glass fragmentation resulting during opening of the ampul. Commonly, the sleeve-type finger protectors merely protect the fingers of the user and do not assist in effectively promoting a clean localized fracture in the constricted neck region of the ampul or container. As a consequence, such devices are not structured to effectively minimize or avoid the occurrence of glass fragmentation during fracture of the container neck. Moreover, as a result the objectionable potentiality that during fracture of the container neck glass fragments may gravitate or be propelled onto the hands of the user or into the container's contents is not effectively alleviated by these prior art devices.

SUMMARY OF THE INVENTION

In accordance with the present invention, a hand tool is provided which not only offers protective manual assistance in opening frangible hermetically sealed ampuls or like containers, but also minimizes fragmentation during opening. Additionally, the hand tool is designed to be reusable with a wide range of container sizes such as, for example, standard ampul sizes ranging from one milliliter to 30 milliliters in capacity.

Structurally, the hand tool of the present invention features an essentially rigid, one-piece body structure. The hand tool is of a size designed to fit within the grasp of one hand of the user and features a bifurcate construction which includes a pair of elongate protective finger grips. The finger grips are deployed in side-by-side relationship and are integrally interconnected at their respective rearward longitudinal ends through a curved bight section. At the opposite or forward longitudinal ends the finger grips are interspaced and thereby together with the bight section cooperate to define a generally U-shaped central recess or cavity within which to insertably accommodate the removable end of an ampul or like container.

The hand tool further features the inclusion of means for selectively concentrating a manually exerted bending force or bending moment in the constricted neck region of the ampul or container in order to promote the generation of a clean break and thereby conversely minimize the potential for fragmentation when the ampul is broken open. In keeping with this latter feature, a relatively narrow edged fulcrum arranged on the forward end portion of one of the finger grips provides a seat upon which to position the constricted neck of the container. On the other finger grip a bearing surface is provided which is adapted to bear against the removable end of the container in response to the application of a manually exerted bending force. In turn, a counteracting bending moment or flexural stress is imparted to and selectively concentrated in the constricted neck of the container by the narrow edge surface of the fulcrum. As a result, the container tends to fracture along a smooth fracture path through the container neck. Consequently, the potential for injury or contamination of the container's contents by glass fragmentation is effectively minimized or avoided. Moreover, the possibility of hand injury caused by jagged residual edges remaining on the separated container sections is also substantially minimized or precluded.

Reusability of the hand tool with larger size ampuls or like containers is afforded by the provision of a transverse aperture which is defined in the bight section of the hand tool and which communicates with the central recess. As thus arranged, the transverse opening serves to provide an end opening in the hand tool through which to accommodate the removable end of containers having a removable end of greater length than the central recess.

Keeping the foregoing in mind, it is a principal objective of the present invention to provide a one-piece, reusable hand tool for use in providing protective manual assistance in opening frangible hermetically sealed ampuls, or like containers, having a main body and a removable end merging therewith through a constricted neck, and which is characterized by the inclusion of a pair of elongate protective finger grips arranged in side-by-side relationship and having interspaced forward end portions and merging rearward end portions cooperating to define a generally U-shaped central recess within which to insertably receive the removable end of the container, and further characterized by the inclusion of means providing a fulcrum upon which to seat the constricted neck of the container and which in response to a manual bending force transmitted through the finger grips will exert a bending moment to the constricted neck to cause the same to fracture.

Another objective is the provision of a hand tool featuring the characteristics of the foregoing objective and which effectively tends to obviate finger contact with the neck portion of the container following fracture thereof.

An additional objective of the present invention is the provision of a hand tool capable of fulfilling the foregoing objectives and which is designed to encourage the container when broken open to fracture along a smooth fracture path and with minimal fragmentation.

A further objective is the provision of a hand tool embodying the characteristics of the foregoing objectives and which also possess the capability of being reusable with a variety of different size ampuls or like containers.

Other objects and advantages of the present invention, as well as the specific nature thereof, will become readily apparent to those ordinarily skilled in the pertinent art from the following detailed description taken in conjunction with the annexed drawings wherein, by way of example only, a preferred embodiment of the present invention is illustrated.

DETAILED DESCRIPTION OF A PREFERRED EMBODIMENT OF THE INVENTION

Figure 1:
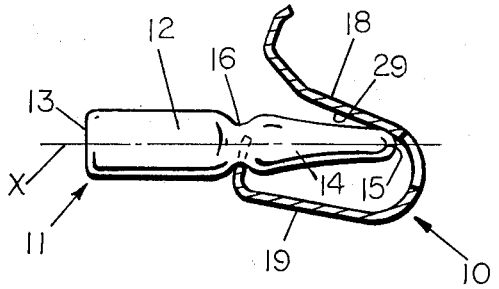
FIG. 1 is a centrally sectioned side view of a preferred embodiment of the hand tool of the present invention and depicting the hand tool positioned over the removable end of a typical ampul of standard one milliliter capacity preparatory to breaking off the removable end to open the ampul.

With reference to FIG. 1 of the drawings, a hand tool generally designated as 10 and embodying the features of the present invention is depicted in exemplary association with a representative container 11 such as a conventional style of hermetically sealed glass ampul. In this regard, while the container is for purposes of characterization of the invention shown and described as being fabricated from glass, it is to be understood that consistent with the needs and properties of the container's contents the container may also be fabricated from other frangible or brittle materials which are similarly susceptible to fracture in response to manually exerted flexural stress. As shown, the container 11 includes a tubular main body portion 12 of cylindrical configuration and closed at one end by an integral bottom wall 13. Projecting axially outward from the opposite end of the main body portion 12 there is a generally conically shaped stem or removable end 14 terminating in a terminal end portion, or rounded tip 15 at its outer extremity, which, in accordance with customary sealing techniques well-known in the art, has been tipped off and closed by flame-sealing to encapsulate its pre-filled contents in hermetically sealed relationship within the protective confines of the container. At its opposite longitudinal end the removable end 14 of the container merges integrally with the main body portion 12 through a peripherally constricted neck 16 which provides a circumferential channel arranged in normally disposed relationship with the central longitudinal axis X of the container 11. By virtue of the constrictive configuration of the neck 16, a peripherally weakened structure is inherently present along the innermost reaches of the constriction. Thus, the constricted neck, as is well-known, functions to define a peripheral fracture zone deployed in essentially normally disposed planar relationship relative to the central longitudinal axis of the container. Frequently, although not shown, a stress-inducing material is applied to the constricted neck 16 to further implement the predisposition of the neck to selectively fracture in the intended manner by following a fracture path residing in the fracture zone.

Figure 3:
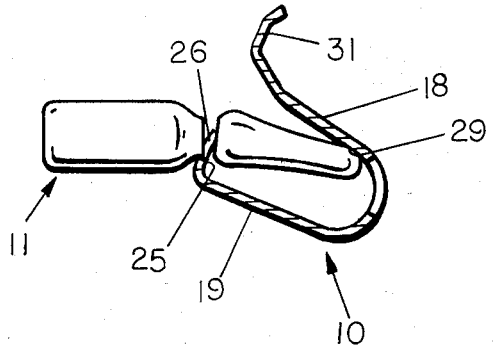
FIG. 3 is a view similar to FIG. 1, but depicting the functional aspects of the hand tool in operational use to assist in manually opening the ampul by selectively fracturing the constricted neck portion thereof.
Figure 2:
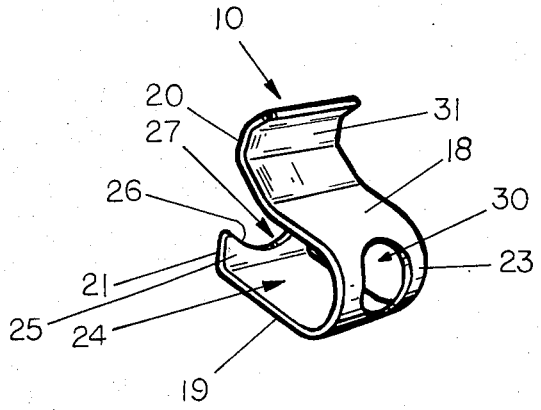
FIG. 2 is an elevational perspective view of the hand tool shown in FIG. 1.

In accordance with the present invention, the hand tool 10 which is best observed in FIG. 2 is formed or otherwise shaped into a one-piece, essentially rigid body structure and may be fabricated from stainless steel or other metal, plastic or corrosion-resistant material capable of imparting structural rigidity and durability to the tool. In FIGS. 1 and 3, the hand tool 10 is shown in association with the container 11 which is depicted in the form of a relatively small size ampul of 1 milliliter standard capacity. By way of relative size comparison between the container 11 and hand tool 10, it will be appreciated that the hand tool is of sufficiently small size to conveniently fit within the grasp of the thumb and finger of one hand of the user and thereby permit the container to be held in proper position in the tool by the user's remaining free hand. Structurally, the hand tool includes a pair of elongate, protective finger grips 18 and 19, which, as shown in FIG. 2, are arranged in side-by-side relationship stretching between interspaced forward end portions 20 and 21 and convergently curved rearward end portions merging integrally together to provide an arcuate bight section 23. As thus structured, the finger grips 18 and 19 together with the bight section cooperate to define a generally U-shaped central recess, as at 24, within which, as shown in FIG. 1, to insertably receive the removable end 14 of an unopened container 11.

In accordance with one of the unique features of the hand tool, fulcrum means provided on one of the finger grips functions to selectively concentrate a manually exerted bending force, or bending movement, at the desired fracture zone in the constricted neck 16 of the container 11. To this end, the foreward end portion 21 of the finger grip 19 includes a flange 25 projecting laterally therefrom and presenting a relatively narrow edge surface 26 extending transversely across and partially restricting the mouth of the central recess 24. To assist in retaining the container 11 with the removable end 14 thereof in centrally positioned relationship within the central recess 24, the edge surface 26 of the flange 25 is preferably shaped to define a central pocket, at 27, in which to position the container 11.

The other finger grip 18 is preferably shaped to diverge laterally away from the finger grip 19 in a direction approaching the forward end portion 20 thereof, and to impart an additional safeguard against finger laceration during opening of a container, the forward end portion 20 of the finger grip 18 is preferably flared outwardly relative to the central recess 24 to provide a protective finger stop 31 designed to shield the user's finger tip from injurious contact with the residual raw edges of the fractured neck segments of the container. The underside of the finger grip 18 borders one side of the central recess 24 and provides a bearing surface 29 which is deployed to face the removable end 14 of the container 11 when the container neck 16 is seated in the central pocket 27 provided in the narrow edge surface 26 of the flange 25 on the opposite finger grip 19.

Figure 4:
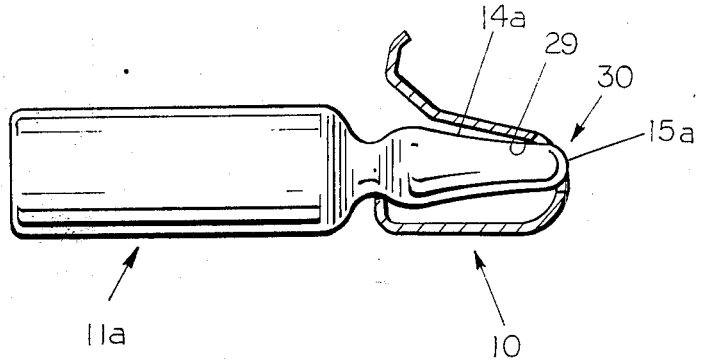
FIG. 4 is a view similar to FIG. 1, but, by way of comparison therewith, depicting the hand tool positioned over a typical larger size standard ampul such as an ampul of thirty milliliter capacity and having a removable end which is of greater length than the length of the hand tool itself.
Figure 5:
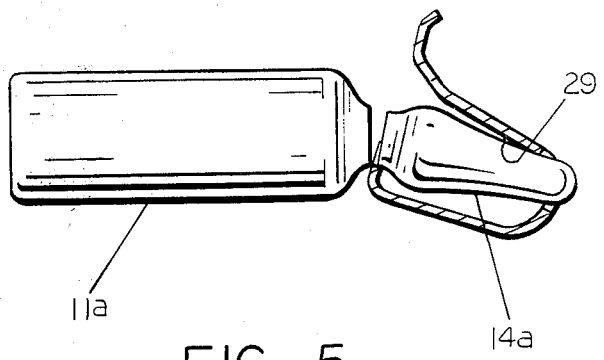
FIG. 5 is a view similar to FIG. 3, but illustrating the functional aspects of the hand tool in assisting removal of the removable end of the larger type of ampul depicted in FIG. 4.

To accommodate reusability of the hand tool 10 with containers having removable ends which are of greater length than that of the central recess 24, a transverse aperture, at 30, which communicates with the central recess 24, is preferably provided, or defined, in the bight section 23 of the hand tool 10. This feature is best depicted in FIGS. 4 and 5, where, as shown, the transverse aperture 30 is deployed to receive therethrough the rounded tip **15*a* of a relatively large size ampul such as a 30 milliliter standard size ampul 11*a*, depicted in FIGS. 4 and 5, having a removable end 14*a* which is of greater length than the central recess 24 provided in the hand tool 10**.

In utilizing the hand tool 10 to open a hermetically sealed ampul, or similar container, the hand tool 10 may be conveniently grasped between the thumb and a finger of one hand of the user while an ampul held in other hand is positioned with its removable end within the central recess, at 24, and with the constricted neck thereof seated in the central pocket, at 27, provided in the narrow edge surface 26 of the flange 25. When so seated, manually exerted pivotal movement of the hand tool and container relative to one another will cause the bearing surface 29 on the hand tool to bear against the removable end of the container. As a result, concentrated bending moment, or flexural stress, will be counteractively imparted by the fulcrum action of the narrow edge surface 26 and directed radially against the constricted neck of the container. Upon application of sufficient manual pivotal force, the container neck will be caused to break along a narrowly defined peripheral fracture path productive of relatively smooth fracture surfaces. As a result, particle fragmentation is effectively minimized or avoided during opening of the container. Also, the formation during breakage of jagged and potentially injurious raw edges are effectively obviated.

In consequence of the structural features of the hand tool of the present invention, the hand tool 10 may be reused with a wide range of various size ampuls, or like containers, and thus eliminate the cost and inconvenience associated with stocking a separate opening device, or tool, for each of the numerous different size ampuls customarily used by physicians, veterinarians, nurses and the like in providing health care services. Moreover, the hand tool of the present invention in structured in such manner that the bearing surface 29 is deployed to selectively transmit the manually applied breaking force against the terminal end portion, or tip, of the removable end of the container. Since this region of the removable end customarily is of relatively small diameter and represents the strongest region of the removable end, the potentiality during opening of the container that breakage may occur at a location other than at the intended fracture zone in the neck region is extremely remote. Additionally, the hand tool is designed to eliminate the need for special manipulative techniques, since the manner of manually holding and pivoting the hand tool and container follows the same basic manipulative procedures which are conventionally employed for opening an ampul in the absence of an accessory opening device or tool.

It will, of course, be understood that various details of construction may be modified throughout a wide range of equivalents, and it is, therefore, not the purpose to limit the scope of the present invention otherwise than as necessitated by the breadth of the appended claims.

I claim:

1. A hand tool for use in providing protective manual assistance in opening frangible hermetically sealed ampuls or like containers having an elongate main body portion and an axially projecting removable end integrally merging with said main body portion through a peripherally constricted neck providing a relatively weakened peripheral fracture zone for accommodating fracturable removal of said removable end in response to a manually applied bending force, said hand tool comprising an essentially rigid one-piece body structure including:

a pair of elongate protective finger grips arranged in side-by-side relationship and having interspaced forward end portions and merging rearward end portions providing a bight section, said finger grips together with said bight section cooperating to define a generally U-shaped central recess therewithin in which to insertably accommodate the removable end of said container;

means on the forward end portion of one of said finger grips providing a fulcrum having a relatively narrow edge surface upon which to seat the constricted neck of said container while the removable end thereof is being accommodated within said central recess;

a bearing surface provided on the other one of said finger grips and deployed to face the removable end of said container when the constricted neck thereof is seated on said fulcrum, said bearing surface being flared outwardly relative to said central recess to provide a protective finger stop, whereby said bearing surface and said fulcrum cooperate in response to a manual bending force transmitted to said container through said finger grips to selectively exert a resultant bending moment to the constricted neck and thereby cause the container to selectively fracture along said fracture zone.

2. A hand tool as defined in claim 1, wherein the edge surface of said fulcrum is disposed transversely of said central recess and defines a pocket in which to seat the constricted neck of said container.

3. A hand tool as defined in claim 2, wherein said pocket is centrally disposed along the edge surface of said fulcrum to assist in retaining the removable end of said container in centrally positioned relationship within said central recess during manual use of said hand tool for removal of said removable end.

4. A hand tool as defined in claim 2, wherein the finger grip providing said bearing surface diverges away from the other finger grip in a direction approaching the forward end portion thereof.

5. A hand tool as defined in claim 1, wherein said bight section defines a transverse aperture communicating with said central recess and providing an end opening in said hand tool through which to accommodate the removable end of containers having removable ends of greater length than said central recess.

6. A hand tool as defined in claim 5, wherein said hand tool is reusable with ampuls of various sizes in the size range between and including 1 to 30 milliliter standard capacity ampuls.

7. A device for opening frangible sealed ampuls having a main body portion and an integral, axially adjacent, constricted neck portion for fracturable removal of the neck by a bending force, said device comprising:

an essentially rigid one-piece body structure;

said body including a pair of elongate protective finger grips arranged in side-by-side relationship and having interspaced forward end portions and merging rearward end portions providing a bight section which together cooperate to define a recess receiving said removable neck;

the forward end portion of one of said finger grips providing a fulcrum having a relatively narrow edge engageable with said neck while in said recess;

the other one of said finger grips providing a bearing surface that is flared outwardly from said recess and facing said removable end of said ampul as said neck thereof engages said fulcrum; said bearing surface and said fulcrum cooperating in response to a bending force on said container through said finger grips thereby causing the fracture of said removable neck portion.

8. A one piece ampul opening tool of relatively rigid construction for breaking the neck of a glass ampul from the integral body thereof at a fracture line comprising:

a concave, contoured edge for engaging the surface of the neck of the ampul at approximately the fracture line, an oppositely spaced bearing surface for engaging an opposite surface of the neck spaced along the axis of the ampul from said fracture line, the said concave edge and said bearing surface being connected by means defining an ampul neck receiving recess, and surface means disposed upwardly and outwardly opposite the bearing surface providing finger support for applying counteracting pivoting force relative to the ampul body for causing the neck to break from the body of the ampul.

* * * * *